US011331522B2

(12) United States Patent
Tanklevskij et al.

(10) Patent No.: US 11,331,522 B2
(45) Date of Patent: May 17, 2022

(54) EXPLOSIVE CAPSULE FOR THERMAL LOCK

(71) Applicants: Obschestvo S Ogranichennoi Otvetstvennostju Fornosovskoe Nauchnoproizvodstvennoe Predpriyatie Gefest, Leningradskaja obl. (RU); JOB LIZENZ GMBH & CO., KG, Ahrensburg (DE)

(72) Inventors: Leonid Timofeevich Tanklevskij, St. Petersburg (RU); Alexander Valerevich Arakcheev, St. Petersburg (RU); Jurgen Teschner, Gamburg (DE); Bodo Muller, Tornesch (DE)

(73) Assignees: JOB LIZENZ GMBH & CO. KG; OBSCHESTVO S OGRANICHENNOI OTVETSTVENNOST JU FORNOSOVSKOE NAUCHNOPROIZODSTVENNOE PREDPRIYATIE GEFEST

( * ) Notice: Subject to any disclaimer, the term of this patent is extended or adjusted under 35 U.S.C. 154(b) by 280 days.

(21) Appl. No.: 16/349,037

(22) PCT Filed: Nov. 3, 2017

(86) PCT No.: PCT/RU2017/000826
§ 371 (c)(1),
(2) Date: Jul. 18, 2019

(87) PCT Pub. No.: WO2018/088937
PCT Pub. Date: May 17, 2018

(65) Prior Publication Data

US 2019/0344110 A1 Nov. 14, 2019

(30) Foreign Application Priority Data

Nov. 10, 2016 (RU) ..... 2016144266

(51) Int. Cl.
*A62C 37/14* (2006.01)
*A62C 31/28* (2006.01)

(52) U.S. Cl.
CPC ..... *A62C 37/14* (2013.01); *A62C 31/28* (2013.01)

(58) Field of Classification Search
CPC ..... A62C 37/14; A62C 31/28; F16K 17/38; F16K 17/383; H01H 37/36; H01H 37/761
See application file for complete search history.

(56) References Cited

U.S. PATENT DOCUMENTS

| | | | |
|---|---|---|---|
| 1,450,219 | A | 4/1923 | Newton |
| 4,981,179 | A | 1/1991 | Klein |

(Continued)

FOREIGN PATENT DOCUMENTS

| | | |
|---|---|---|
| CA | 2075397 | 2/1993 |
| RU | 97642 | 9/2010 |
| WO | 2006011725 | 2/2006 |

*Primary Examiner* — Steven M Cernoch
(74) *Attorney, Agent, or Firm* — Sand, Sebolt & Wernow Co., LPA

(57) ABSTRACT

The invention relates to the field of firefighting equipment, in particular to thermal locks for sprinklers, and is intended for opening sprinklers and automatically initiating the fire extinguishing. The proposed invention is characterized in that in an explosive capsule for a thermal lock comprising a housing made of brittle material, which contains a sealed cavity filled with liquid and a state sensor comprising an electrical conductor partially arranged within the housing cavity; the electrical conductor arranged within the housing cavity is divided into two parts, wherein the ends of each part contact with the liquid, while the liquid used has electrically conductive properties.

6 Claims, 1 Drawing Sheet

(56) References Cited

U.S. PATENT DOCUMENTS

| | | | | |
|---|---|---|---|---|
| 5,459,812 | A * | 10/1995 | Taylor | H05B 3/82<br>392/498 |
| 2004/0194976 | A1 | 10/2004 | Kreizschmar | |
| 2007/0240886 | A1 * | 10/2007 | Kil | A62C 37/11<br>169/39 |

* cited by examiner

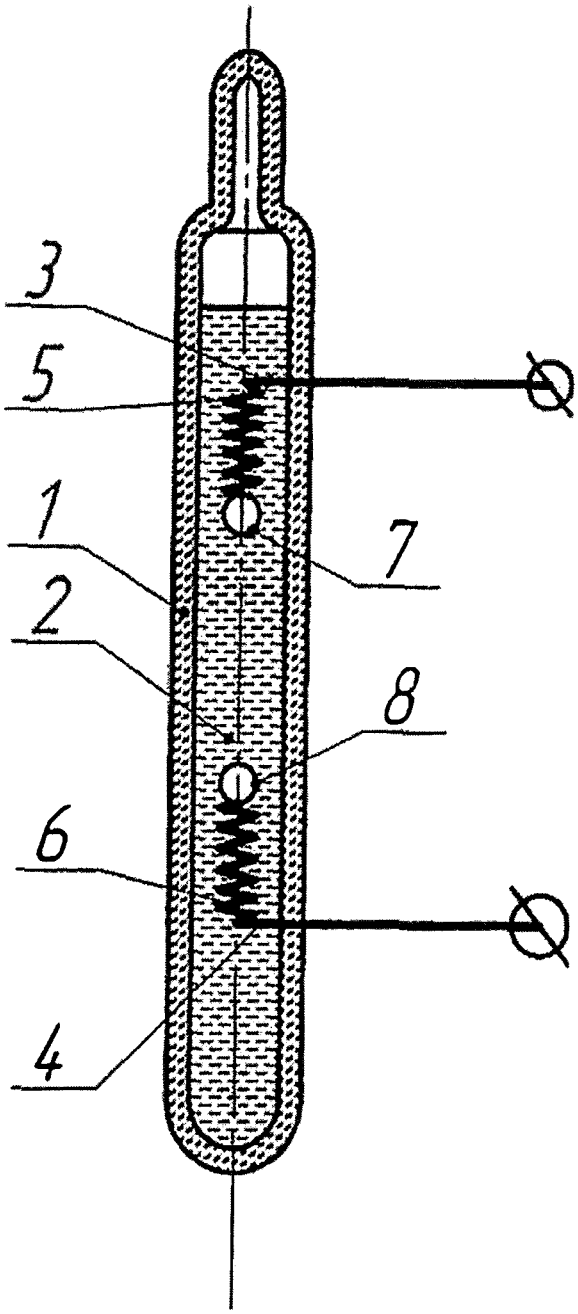
3
5
1
7
2
8
6
4

EXPLOSIVE CAPSULE FOR THERMAL LOCK

The proposed invention relates to the field of firefighting equipment, in particular to thermal locks for sprinklers, and is intended for opening sprinklers and automatically initiating the fire extinguishing.

The closest prior art of the proposed invention is a capsule for a thermal lock, which is known from a firefighting device (U.S. patent No. US 2004/0194976 "Firefighting device").

The known device comprises a capsule of the thermal lock, said capsule is made of a glass housing filled with liquid. The housing is connected to a state sensor. The sensor includes an 10 electric wire, partly situated inside the cavity of the glass housing. The electric wire is connected to the line of the control and monitoring unit. When a fire starts, the housing and the liquid inside are heated. When the liquid comes to a boil, the capsule housing is ruptured and the state sensor opens, which sends a signal to the control and monitoring unit that the thermal lock has been activated.

The disadvantage of the prior art is the unreliable state monitoring.

The disadvantage of the prior art is due to the possible "non-rupture" of the state sensor, for example if the junction of the wire and the line of the control and monitoring unit becomes "acidified" when the thermal lock has been in service for a lengthy time.

The purpose of the proposed invention is to enhance the reliability of monitoring the state of the sprinkler.

The proposed invention is characterized in that, in the explosive capsule for a thermal lock comprising a housing made of brittle material, which contains a sealed cavity filled with liquid and a state sensor comprising an electrical conductor partially arranged within the housing cavity, the electrical conductor arranged within the housing cavity is divided into two parts, wherein the ends of each part contact with the liquid, while said liquid has electrically conductive properties.

In preferred embodiments of the capsule for a thermal lock

- the liquid used has a resistance ensuring that said liquid is heated to the boiling point when an electric current passes therethrough;
- the free ends of the electrical conductor situated inside the housing cavity are equipped with heating elements;
- the free ends of the electrical conductor situated inside the housing cavity are equipped with elements increasing the contact area with the liquid;
- the free ends of the heating elements are equipped with elements increasing the contact area with the liquid.

The characteristic features of the proposed invention are:

1. The electrical conductor, situated inside the housing cavity, is divided into two parts—feature.

2. The free ends of each part of the electrical conductor situated inside the housing contact with the liquid—feature.

3. The liquid used has electrically conductive properties—feature.

4. The liquid used has a resistance ensuring that said liquid is heated to the boiling point when a current is passed therethrough—feature.

5. The free ends of the electrical conductor situated inside the housing cavity are equipped with heating elements—feature 6. The free ends of the electrical conductor situated inside the housing cavity are equipped with elements increasing the contact area—feature 7. The free ends of the heating elements are equipped with elements increasing the contact area—feature The essence of the proposed invention consists in the following:

Dividing the electrical conductor situated inside the housing cavity into two parts (feature 1), wherein the free ends of each part of the electrical conductor situated inside the housing contact with the liquid (feature 2); said liquid has electrically conductive properties (feature 3), which enhance the reliability of monitoring the state of the thermal lock since upon the capsule's rupture 20 due to the fire exposure, the electrically conductive liquid flows out of the capsule cavity; said liquid, being an element in a circuit for monitoring the state, causes the break in the state monitoring circuit. There is no "non-rupture" effect of the state sensor.

The use of a liquid having a resistance ensuring its heating to the boiling point when an electric current is passed therethrough (feature 4) enables a forced rupture of the capsule and a triggering of the sprinkler.

Equipping the free ends of the electrical conductor situated inside the housing cavity with heating elements (feature 5) enables the use of the sensor for determining the state of the lock as a forced activation of the thermal lock.

Equipping the free ends of the electrical conductor situated inside the housing cavity with elements increasing the contact area (feature 6) decreases the contact resistance.

Equipping the free ends of the heating elements with elements increasing the contact area with the liquid (feature 7) decreases the contact resistance between the free ends of the heating elements.

The sketch presented shows a general view of the capsule for a thermal lock in cross section.

The capsule consists of housing (1), whose internal cavity is filled with electrically conductive liquid (2). Free ends (3) and (4) of the electrical conductor of the state sensor are situated inside the cavity in contact with the liquid. Free ends (3) and (4) are equipped with heating elements (5) and (6) in the form of spirals. Shaped as balls elements (7) and (8), increasing the contact area with the liquid, are arranged on the free ends of the heating elements.

The capsule works as follows. In standby mode, the current in the state monitoring circuit of the lock flows through the parts of the conductor and through the current-conducting liquid. If a fire starts in the zone where the thermal lock is located, the lock is heated, the liquid boils, and the capsule housing is ruptured. The rupturing of the capsule results in the escape of the electrically conductive liquid and as a consequence, the breaking of the state monitoring circuit of the lock. The breaking of the circuit indicates the triggering of this lock.

When a forced triggering of the lock from a monitoring and control unit is required, a signal is sent to the state monitoring circuit by a voltage ensuring that the electrically conductive liquid is heated with the heating elements to the boiling point of the liquid filling the capsule. After this, the rupturing of the capsule and the opening of the lock occurs.

The invention claimed is:

1. An explosive capsule for a thermal lock, comprising;

a housing made of brittle material;

a sealed cavity defined in said housing;

liquid substantially filling the sealed cavity, wherein the liquid has electrically conductive properties; and a state sensor comprising an electrical conductor partially arranged within the housing cavity;

wherein the electrical conductor arranged within the housing cavity is divided into two parts, and each of the two parts has a free end which terminates in the liquid;

wherein the free ends of the electrical conductor situated inside the housing cavity are equipped with heating elements;

wherein the heating elements are equipment with elements increasing the contact area with the liquid;

wherein the elements increasing the contact area with the liquid are spaced a distance apart from one another and are only electrically connected to one another by the liquid; and wherein the free end of each part of the two parts remains in contact with the liquid from when the explosive capsule is in a standby mode up until the housing ruptures.

2. The explosive capsule for a thermal lock according to claim 1, wherein the liquid used has electrical conductivity ensuring that said liquid is heated to the boiling point when triggering electric current passes therethrough.

3. The explosive capsule according to claim 1, wherein when in the standby mode current flows through the two parts of the electrical conductor and through the current-conducting liquid.

4. The explosive capsule according to claim 1, wherein the free ends of the two parts of the electrical conductor are in contact with the liquid during a fire and up until the liquid reaches its boiling point and rupturing the housing.

5. The explosive capsule according to claim 1, wherein the free ends of the two parts of the electrical conductor are in contact with the liquid until a forced triggering event occurs and the housing ruptures.

6. The explosive capsule according to claim 5, wherein during a forced triggering event a voltage is received, and the electrically conductive liquid is heated by the heating elements to a boiling point of the liquid in the housing, thereby rupturing the housing.

* * * * *